United States Patent [19]

Perr

[11] Patent Number: 5,076,240

[45] Date of Patent: Dec. 31, 1991

[54] ARTICULATED OPEN NOZZLE HIGH PRESSURE UNIT FUEL INJECTOR

[75] Inventor: Julius P. Perr, Columbus, Ind.

[73] Assignee: Cummins Engine Company, Inc., Columbus, Ind.

[21] Appl. No.: 534,234

[22] Filed: Jun. 7, 1990

[51] Int. Cl.[5] ..... F02M 37/04

[52] U.S. Cl. ..... 123/501; 123/502; 239/88

[58] Field of Search ..... 123/447, 506, 467, 500, 123/501; 239/88-96, 533.1-533.12

[56] References Cited

U.S. PATENT DOCUMENTS

| | | | |
|---|---|---|---|
| 3,831,846 | 8/1974 | Perr et al. | 239/89 |
| 3,982,693 | 9/1976 | Holsing | 239/88 |
| 4,129,256 | 12/1978 | Bader, Jr. et al. | 123/506 |
| 4,149,506 | 4/1979 | Muntean et al. | 123/139 AK |
| 4,249,499 | 2/1981 | Perr | 123/502 |
| 4,280,659 | 7/1981 | Gaal et al. | 239/124 |
| 4,527,738 | 7/1985 | Martin | 239/90 |
| 4,571,161 | 2/1986 | Leblanc et al. | 123/509 |
| 4,601,086 | 7/1986 | Gerlach | 29/156.4 |
| 4,721,247 | 1/1988 | Perr | 239/91 |
| 4,784,101 | 11/1988 | Iwanaga et al. | 123/506 |
| 4,976,245 | 12/1990 | Takahashi et al. | 123/501 |
| 4,986,572 | 1/1991 | Warlick et al. | 239/88 |

*Primary Examiner*—Carl Stuart Miller
*Assistant Examiner*—Erick Solis
*Attorney, Agent, or Firm*—Sixbey, Friedman, Leedom & Ferguson

[57] ABSTRACT

The present invention is directed to open nozzle unit fuel injectors for injecting a metered quantity of fuel into the cylinder of an internal combustion engine, as synchronously controlled by a drive train, wherein the unit fuel injector comprises an injector body with a reciprocably movable plunger assembly disposed therein. The present invention is more specifically directed to a high pressure open nozzle unit fuel injector including a mechanism for injecting fuel at SAC pressures of 30,000 psi or more. Moreover, the plunger assembly comprises a two-piece plunger with a variable timing chamber and a timing plunger inbetween the upper and lower plungers. Additionally, the lower plunger includes an articulated tip which is movable axially by a small degree with respect to a lower portion of the lower plunger such that trapped fuel volume pressure within the unit injector metering chamber just after injection can be beneficially used to hold the articulated tip in sealing engagement with its cup seat to effectively close off the injection orifices and prevent secondary injection. At the same time, the over-travel experienced within the upper plunger as driven by the drive train is absorbed by the timing mechanism such that the articulated tip does not experience the over-travel.

27 Claims, 3 Drawing Sheets

38
56
40
42
112
58
114
44
TIMING FUEL
DRAIN
INJECTED FUEL
METERING & TIMING 38
56
40
42
112
58
114
44
INJECTION 38
56
40
94
42
62
114
44
OVER RUN 38
40
94
42
62
114
44
SCAVENGE

ARTICULATED OPEN NOZZLE HIGH PRESSURE UNIT FUEL INJECTOR

TECHNICAL FIELD

The present invention relates to unit fuel injectors, and in particular, those of the type having an open nozzle and a reciprocating injection plunger that is mechanically actuated by an engine camshaft.

BACKGROUND OF THE INVENTION

Heretofore, various type fuel injectors and fuel injection systems have been known in the prior art which are applicable to internal combustion engines. Of the many types of fuel injection systems, the present invention is directed to unit fuel injectors, wherein a unit fuel injector is associated with each cylinder of an internal combustion engine and each unit injector includes its own drive train to inject fuel into each cylinder on a cyclic basis. Normally, the drive train of each unit injector is driven from a rotary mounted camshaft operatively driven from the engine crankshaft for synchronously controlling each unit injector independently and in accordance with the engine firing order.

Of the known unit injectors of such fuel injection systems, there are two basic types of unit injectors which are characterized according to how the fuel is metered and injected. A first type to which the present invention is oriented is known as an "open nozzle" fuel injector because fuel is metered to a metering chamber within the unit injector where the metering chamber is open to the engine cylinder by way of injection orifices during fuel metering.

In contrast to the open nozzle type fuel injector, there are also unit fuel injectors classified as "closed nozzle" fuel injectors, wherein fuel is metered to a metering chamber within the unit injector while the metering chamber is closed to the cylinder of an internal combustion engine by a valve mechanism that is opened only during injection by the increasing fuel pressure acting thereon. Typically, the valve mechanism is a needle type valve.

In either case, the unit injector typically includes a plunger element that strikes the metered quantity of fuel to increase the pressure of the metered fuel and force the metered fuel into the cylinder of the internal combustion engine. In the case of a closed nozzle injector, a tip valve mechanism is provided for closing the injection orifices during metering with the tip valve biased toward its closed position thereby insuring that injection will take place only after the fuel pressure is increased sufficiently to open the tip valve mechanism.

The present invention is directed to the open nozzle type fuel injector, and more specifically to a unit injector fuel injection system that relies on pressure and time principles for determining the quantity of fuel metered for each subsequent injection of each injector cycle. Moreover, the pressure time principles allow the metered quantity to be varied for each cyclic operation of the injector as determined by the pressure of the fuel supplied to the metering chamber and the time duration that such metering takes place.

Such open nozzle fuel injectors are constantly subject to modifications in order to comply with increasingly higher levels of pollution control and the need for greater fuel economy. From this standpoint, such open nozzle unit fuel injectors have been developed, designed to comply with these requirements while at the same time providing a fuel injector of simplified design with associated cost reductions, and providing reliable and precise control of independently variable fuel injection timing and quantity parameters.

Examples of unit injectors of the open nozzle type are described in detail in U.S. Pat. Nos. 4,280,659 and 4,601,086 to Gaal et al. and Gerlach, respectively, both of which are owned by the assignee of the present invention. The injectors of Gaal et al. and Gerlach include a plunger assembly with a lower portion having a major diameter section that is slidable within an axial bore of the injector body and a smaller minor diameter section that extends within a cup of the injector body. The cup provides an extension to the axial bore which is smaller in diameter than the diameter of the axial bore that passes through the remainder of the injector body. During the metering stage of the Gaal et al. and Gerlach injectors, fuel is metered through a supply port into the axial bore at a point above the cup, and the fuel flows around the minor diameter section of the plunger assembly at the tip thereof for metering a specified quantity of fuel into the metering chamber of the cup. A radial gap is formed between the minor diameter section of the plunger assembly and the inner wall of the bore within the cup. This gap facilitates the flow of fuel to the injector tip to be injected. Once the metering stage is completed, the plunger travels inwardly (defined as toward the engine cylinder of an internal combustion engine) so as to cause injection of the fuel from the metering chamber through the injection orifices.

The stage just after the fuel injection has been completed is known as the crush stage, wherein the plunger tip is held tightly against a seat of the cup by the associated drive train for the unit fuel injector. During this crush stage, fuel is trapped within the radial gap between the minor diameter section of the plunger and the inner wall of the bore within the cup, as well as between the major diameter section of the plunger assembly and the end of the axial bore of the injector body. This quantity of fuel is known as the trapped volume.

A problem that is unique to such open nozzle type unit fuel injectors is that many of these known injectors permit a "secondary injection", which is leakage of fuel from the injector after injection should have been stopped. Such secondary injection is due to the trapped volume of fuel that is under high pressure near the bottom of the plunger tip. Such high pressure has the effect of forcing the plunger outwardly (that is defined as "away from" the engine cylinder) after the plunger is fully advanced to close the injection orifices by the cam. Thus, outward movement of the plunger and unseating of its tip allow trapped fuel leakage into the cylinder. Consequently, there is an amount of unburned and partially burned fuel remaining in the cylinder at the start of the exhaust stroke of a typical four-stroke cycle, which is due both to the abovementioned secondary injection as well as to inefficient combustion. This fuel specifically accounts for a large part of the visible smoke and unburned hydrocarbons emitted by the engine. It is, therefore, quite clear that the amount of harmful emissions would be reduced if the fuel injection were abruptly terminated at the point when combustion does not fully take place.

In order to more effectively seal the injection orifices from the metering chamber after injection, and to lessen the possibility of secondary injection, the injector plunger is typically driven by an amount further than when the plunger tip first contacts the seat of the injector cup. This travel is referred to as over-travel of the injector plunger which more tightly seals the plunger tip against the cup seat. However, the over-travel also raises the pressure of the trapped volume of fuel and still causes the aforedescribed tendency of the plunger tip to be lifted resulting in secondary injection. In fact, over-travel raises the pressure to at least partially counteract the effect of the over-travel. Another major disadvantage associated with over-travel is that the over-travel causes greater stress on the cam, plunger, and connection between the injector cup and barrel assembly. These stresses tend to cause injector failures due to excessive wear or breakage.

An attempt was made as described in U.S. Pat. No. 3,831,846 to Perr et al., which is owned by the assignee of the present invention, to eliminate secondary injection in an injector operating on the basis of plunger over-travel. In each of the disclosed embodiments, the plunger is divided into a plunger portion and a tip valve portion which are axially relatively movable by a small degree. The Perr et al. injector requires injector over-travel as a means to effectively close the injection orifices from the metering chamber after injection, particularly during the engine compression stroke, as in the above-noted prior art injectors. However, then to assist in holding the tip valve against the injection orifices and to prevent secondary injection, the trapped volume of fuel is utilized in addition to the hold down force from over-travel to hold the tip valve against the cup seat instead of forcing the tip away from the valve seat. This is accomplished by the axial separation between the main plunger assembly and the tip valve, wherein a pressure regulating passage through the tip valve, permits trapped volume near the injector tip to be forced upwardly near the upper end of the tip valve to act thereon and force the tip valve inwardly against the valve seat. Such movement is facilitated by the separation of the tip valve from the main plunger assembly and the pressure relief passage from the tip valve. Of course, the pressure of the trapped volume of fuel within the tip of the metering chamber is increased by the over-travel imparted to the tip valve by the plunger assembly from its associated drive mechanism. This over-travel purposefully being used to force trapped fuel through the pressure relief passage to act against the upper end of the tip valve.

Other similar injectors are also the subject of U.S. Pat. Nos. 4,249,499 to Perr and 4,149,506 to Muntean et al., both also commonly owned by the assignee of the present invention. These devices are based on the same tip principles as that described above with respect to the Perr et al. '846 device, which operate in unit injectors with plunger over-travel.

In a distinct other area of open nozzle injector modification for improving fuel injection for more efficient fuel burning and cleaner emissions, it has been suggested to increase the pressure of injection immediately at the injector tip. Such pressure increase has been found to more efficiently burn the injected fuel. One such example of a high pressure unit fuel injector is disclosed in U.S. Pat. No. 4,721,247 to Perr, also commonly owned by the assignee of the present invention. In this case, high SAC pressures in excess of 30,000 psi during injection have been encountered. The high pressure unit injector was designed to accommodate such high injection pressures without suscepting the injector to failure or destruction caused by the stresses associated with such high pressures. In order to do this, the injector was designed without a cup, per se, but combines the injector cup with a portion of the injector body which connects to the main injector body at a point above the high pressure zone of the metering chamber. Moreover, the Perr '247 injector includes a precise manner of controlling a timing chamber formed between separable portions of the plunger assembly for controlling the high pressure injection. By appropriately expanding and retracting the timing chamber, the start and finish of injection can be accurately controlled. Moreover, engine over-travel is absorbed by the collapse of the timing chamber as regulated to control the degree of flow of fuel from the timing chamber.

Yet another high pressure unit fuel injector is illustrated and described in co-pending application Ser. No. 402,893 filed Sep. 5, 1989 and also commonly owned by the assignee of the present invention. In this high pressure unit fuel injector, the timing chamber pressure is controlled by way of a low speed valve mechanism provided with a dual spring feature. The object of that invention is to more precisely control injection timing by way of the dual spring, low speed valve mechanism. Otherwise, the high pressure injector operates on the same principles enumerated above with respect to the Perr '247 high pressure unit fuel injector, in that plunger over-travel is controlled by the collapse of the timing chamber under the influence of the valve mechanism and various passages.

These high pressure open nozzle unit fuel injectors also suffer from the above-described problem of secondary injection even though they do not experience the pressure increases associated with over-travel because of the high pressures associated with the high pressure unit injectors themselves. In other words, the high pressure of the fuel trapped just after injection is sufficient in such a high pressure unit injector to cause secondary injection without overtravel of the plunger tip. Clearly, there is a need for a means to prevent secondary injection in such a high pressure open nozzle unit fuel injector.

SUMMARY OF THE INVENTION

It is, thus, a primary object of the present invention to provide an open nozzle unit fuel injector which eliminates secondary injection within a unit injector that does not experience plunger over-travel or crush after injection.

It is another object of the present invention to provide a high pressure open nozzle unit fuel injector including a plunger assembly with a timing chamber formed therein and a means for preventing "secondary injection", which is the leakage of fuel from the injector orifices caused by the trapped volume of fuel surrounding the injection plunger just after injection. The trapped volume experiences pressures that tend to lift known injection plungers from their seats allowing leakage into an engine cylinder.

It is a further object of the present invention to provide such a high pressure open nozzle unit injector with an articulated tip which is relatively movable in an axial direction with respect to the plunger assembly, wherein the articulated tip does not experience the over-travel that is imparted to the plunger assembly and which effectively seals the tip thereof against the cup seat for preventing secondary injection. The articulated tip requires a minimized plunger hold-down force after injection which reduces the load on the high pressure unit injector. Moreover, this means the injector train loads can be reduced which increases life and reduces friction and parasitic losses of the injection system.

It is yet another object of the present invention to provide such an articulated tip in a high pressure open nozzle unit fuel injector with a spring bias which can urge the tip toward the seat, or away from the seat. It is also contemplated that the articulated tip can be free-floating. Also advantageously, the holddown force for the articulated tip can be generated by a small spring within the injector which will make the injector system less sensitive to train wear or injector missetting.

The above objects and advantages of the present invention can be achieved by an open nozzle unit fuel injector including a fuel injector body formed of two sections, wherein a cup section extends outwardly (that is, away from the tip) sufficiently to connect to a barrel portion at a point above the metering chamber that is not subject to the high injection pressures. The injector plunger assembly includes an upper plunger portion, a timing plunger, a lower plunger and an articulated tip associated with the lower plunger. A timing chamber is formed between the upper plunger and the timing plunger and is controlled by inlet and outlet fuel passages such that the timing chamber is expanded during metering and timing, operates as a hydraulic link during injection and over-travel, and collapses during over-travel and a scavenge cycle. The timing plunger controls the expansion and collapse of the timing chamber, particularly with respect to the controlled collapse for absorbing over-travel after injection. The control of the timing chamber is further facilitated by a dual spring, low speed valve mechanism mounted with the lower plunger assembly. The articulated tip is connected to the lower plunger by way of a cup-like retainer fitted to the lower end of the lower plunger which retains a head of the articulated plunger therein. Preferably, the head of the plunger is biased by a spring within the cup-like retainer in a direction to contact the lower plunger. As a result, after injection, the device advantageously prevents secondary injection because the high pressure fuel trapped within the metering chamber around the articulated tip acts against the upper end of the articulated tip to firmly hold the articulated tip against the seat of the injector. This occurs, even though the articulated tip does not experience over-travel. Also, there is no need for a pressure release or spill passage through the injector tip.

These and further objects, features and advantages of the present invention will become more apparent from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
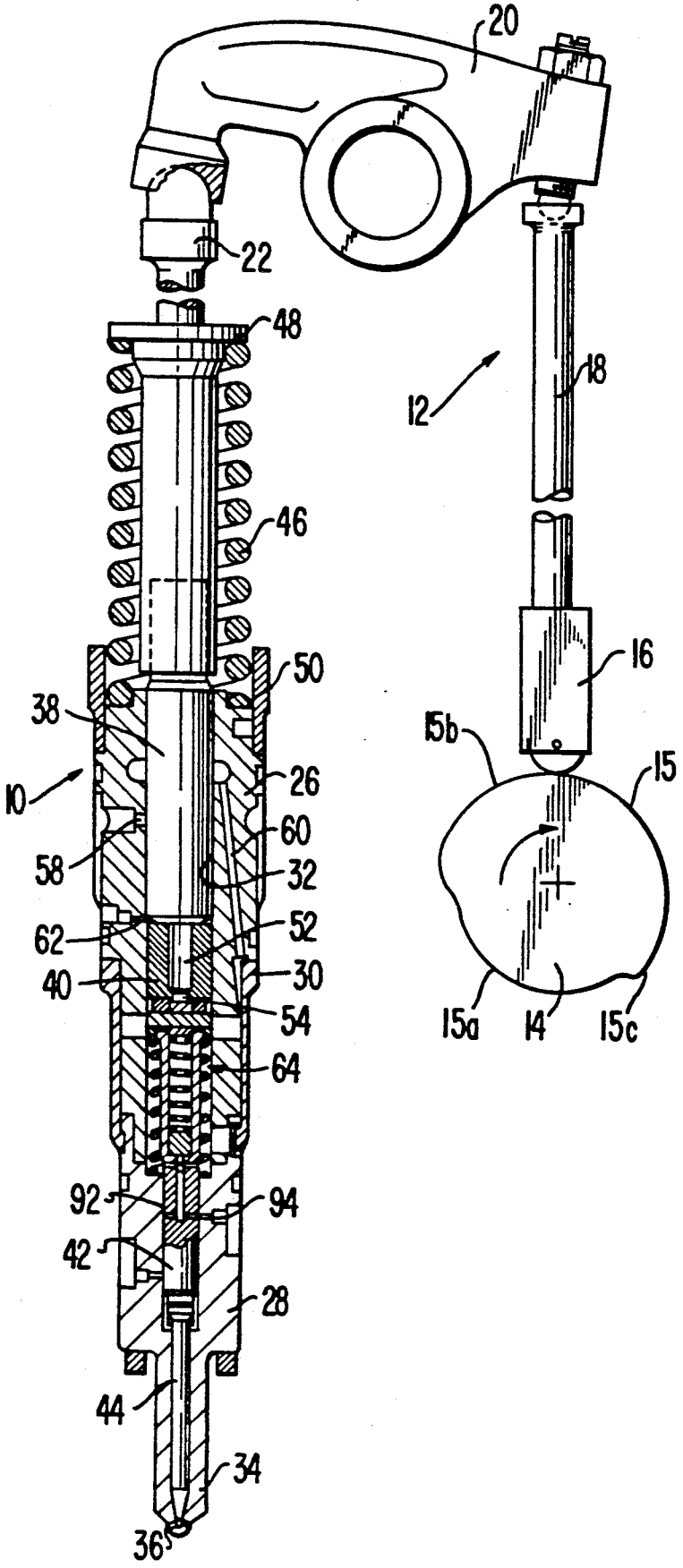
FIG. 1 is a schematic illustration of a preferred open nozzle high pressure unit fuel injector designed in accordance with the present invention and the associated drive train for operating the unit injector.

With reference now to the Figures, and in particular to FIG. 1, a unit fuel injector 10 is illustrated with an associated drive train 12. Such a drive train 12 typically includes a camshaft 14, a cam follower 16, a push rod 18, a rocker arm 20 pivotally supported on the engine head assembly (not shown) and an actuator rod 22. The camshaft 14, cam follower 16 and push rod 18 typically are supported and relatively movable within the head and block of an internal combustion engine in a conventional fashion.

The cam 14 further is provided with a cam surface 15 divided into two major portions 15*a* and 15*b* with a third relatively small portion 15*c*. Portion 15*a* Corresponds to a retracted position of the unit fuel injector 10, portion 15*b* corresponds to an advanced position of the unit fuel injector 10, and portion 15*c* corresponds to the injection period of the unit fuel injector 10 including an over-travel stage. These positions and stages of the unit fuel injector 10 will be more apparent below after the description thereof.

The unit fuel injector 10 described is a high pressure unit fuel injector capable of achieving SAC pressures in excess of 30,000 psi during injection. Such a high pressure unit fuel injector capable of achieving such pressures is disclosed in U.S. Pat. No. 4,721,247 owned by the assignee of the present invention and incorporated completely herein by reference. Moreover, another such high pressure unit injector is disclosed in U.S. Pat. application Ser. No. 402,893, filed Sept. 5, 1989, also owned by the assignee of the present invention and completely incorporated herein by reference.

It is further understood that one unit fuel injector 10 is provided for each cylinder of an internal combustion engine, and each injector and cylinder includes an associated drive train 12. Typically, the camshaft 14 will include a single lobe for controlling each one of the unit fuel injectors.

The unit fuel injector 10 is comprised of a barrel 26 and a one-piece injector cup 28. The injector cup 28 and barrel 26 are axially aligned and secured together by a sleeve 30. Within the barrel 26, and injector cup 28, an axial bore 32 is provided extending entirely through the barrel 26 and terminating within the tip 34 of the injector cup 28. The lower portion of the axial bore 32 within tip 34 has a smaller diameter for reasons which will be apparent below. The axial bore 32 is opened through the tip 34 by injection orifices 36 which open into the cylinder of an internal combustion engine. Preferably, a plurality of injection orifices 36 are provided which are spaced and directed to optimize fuel injection.

A plunger assembly is provided for reciprocating motion along with the actuator rod 22 under the influence of the drive train 12. The reciprocating motion is defined between a fully retracted position corresponding to cam surface 15*a* and a fully advanced position corresponding to cam surface 15*b*. The plunger assembly is comprised of an upper plunger assembly 38, a timing plunger 40, a lower plunger 42 and an articulated tip 44. The upper plunger assembly 38 is biased upwardly by a return spring 46 acting between an upper ledge 48 of the upper plunger assembly 38 and a shoulder 50 on the upper end of barrel 26. Thus, the plunger assembly is biased towards its fully retracted position.

Figure 2A:
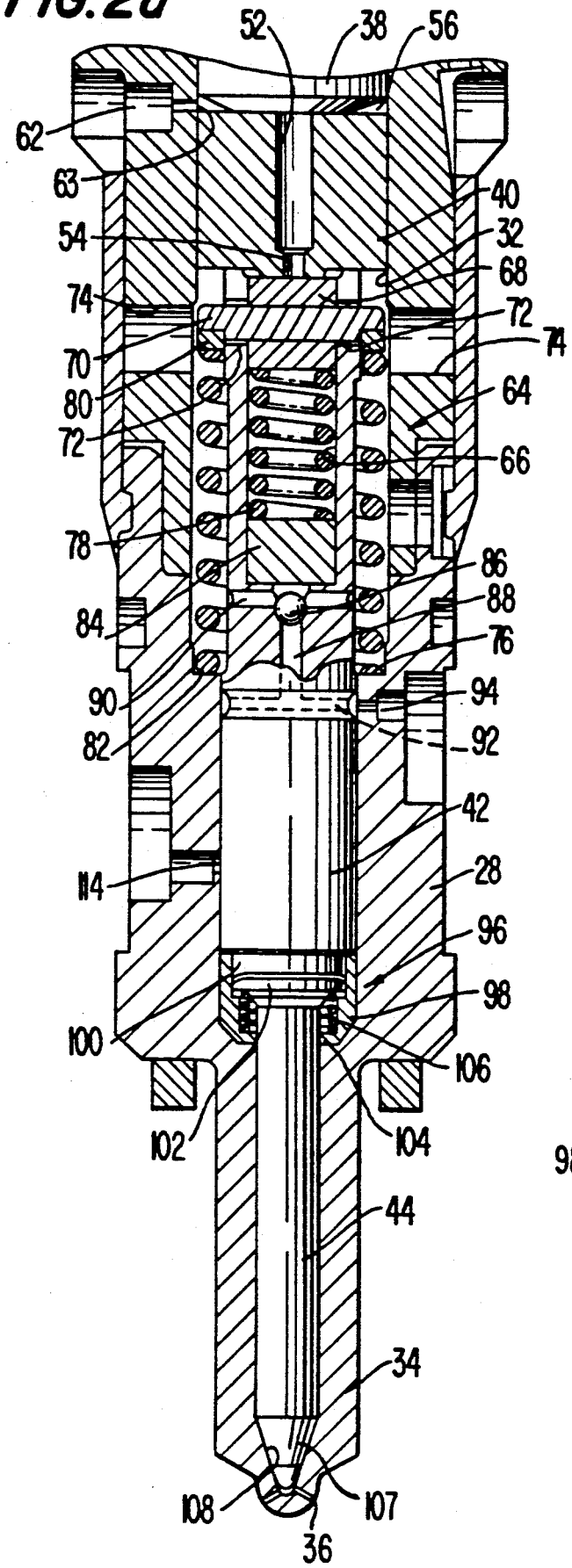
FIG. 2*a* is an enlarged cross-sectional view of the lower half of the unit injector illustrated in FIG. 1 detailing the articulated tip of the present invention and its association with the low speed valve mechanism of the lower plunger.
Figures 3A, 3B, 3C, 3D:
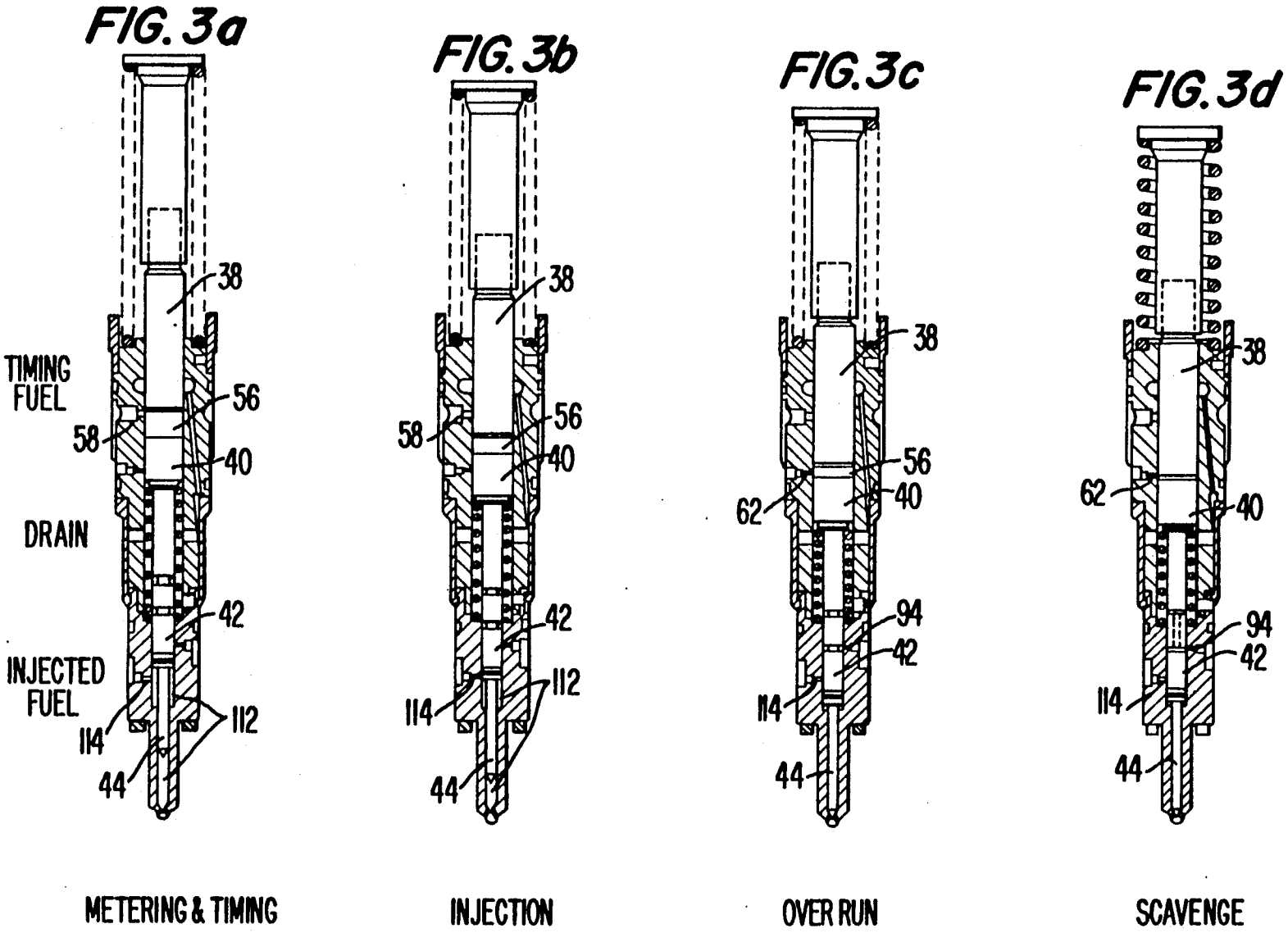
FIGS. 3*a*, 3*b*, 3*c* and 3*d* are illustrations of the positions of the plunger assembly and articulated tip during a cycle of the unit injector designed in accordance with the present invention.

As best seen in FIG. 2a, the timing plunger 40 includes an axial bore 52 and a metering orifice 54 which controls the rate of flow of fluid through the timing plunger 40. Between the timing plunger 40 and the upper plunger assembly 38, an expansible and collapsible timing chamber is formed at 56 during the cyclic injector operation as illustrated in FIG. 3a and amplified below in the description of the operation of the invention. Referring back to FIG. 1, a timing feed port 58 is provided for supplying pressurized fluid, preferably fuel, to the timing chamber 56 for expanding the timing chamber 56 during the appropriate stage of the injector cycle. A relief passage 60 is also shown passing through barrel 26 for permitting fuel leakage to escape from around the upper plunger assembly 38. Also, for providing a restricted relief for fuel to leave the timing chamber 56, a restricted spill passage 62 is provided through barrel 26 allowing fuel to leave the timing chamber 56 when the timing plunger 40 is advanced to a position uncovering an outlet port 63 of the restricted spill passage 62.

Referring again to FIG. 2a, a low speed valve mechanism 64 is illustrated for controlling the release of fluid through the timing plunger 40 by way of metering orifice 54. This feature is the subject of the above-noted co-pending application Ser. No. 402,893 filed Sep. 5, 1989. The low speed valve mechanism 64 is provided mostly within the lower plunger 42. An axial bore 66 is provided within lower plunger 42 open from the top end thereof within which a plunger valve 68 is disposed. The plunger valve 68 carries a transverse pin 70 passing through a transverse bore within the plunger valve 68 to be tightly secured therein. The transverse pin 70 extends radially outward from the plunger valve 68 and through slots 72 within the lower plunger 42. The axial length of the slots 72 are slightly larger than the axial length of the transverse pin 70 such that the transverse pin 70 and plunger valve 68 are axially movable by the difference between the two axial lengths along the lower plunger 42. This movement permits opening and closing of the metering orifice 54 allowing passage, or blocking passage, of timing fluid through the timing plunger 40. When the plunger valve 68 is axially shifted away from the timing plunger 40, the metering orifice 54 is opened thereby permitting fuel passage through the bore 52 and orifice 54 of timing plunger 40 and around the upper end of the lower plunger 42. The fuel then exits the injector assembly through spill ports 74 located on either side of the low speed valve mechanism 64.

The low speed valve mechanism 64 further includes a dual spring assembly including an outer spring 76 and an inner spring 78. The outer spring acts between a shoulder 82 within the one-piece injector cup 28 and a retainer ring 80 which further acts against the transverse pin 70. The effect of the outer spring is to upwardly bias the transverse pin 70 and plunger valve 68 upwardly to close the metering orifice 54 of the timing plunger 40. The inner spring 78 is disposed within the bore 66 of lower plunger 42 and secondarily directly biases the plunger valve 68 upwardly. Located just below the inner spring 78 lies a fixed stop element 84 which abuts the lower end of the inner spring 78 such that the inner spring 78 and stop element 84 move entirely with the lower plunger 42, and for retaining a check valve ball element 86 located therebelow. The check valve ball element 86 allows one way fluid flow between axial passage 88 and radial passages 90 opening to the area of the axial bore 32 of the injector which is open to spill ports 74. The axial passage 88 is connected at its lower end to at least one other radial passage 92 spaced below the radial passages 90 for connection to a scavenge supply port 94 when the plunger assembly is in a fully advanced position as is illustrated in FIG. 2a.

At the lower end of the lower plunger 42, the articulated tip 44 is provided to move axially relative to the lower plunger by a limited distance. For doing this, a connecting means 96 is provided which allows the relative but limited axial movement of the articulated tip 44 with respect to the lower plunger 42. The connecting means 96 includes a retainer 98 which is press-fitted at the bottom of the lower plunger 42 to a boss 100. Preferably, the connection between the retainer 98 and boss 100 is a press-fit which may be further facilitated by a rib-and-groove engagement on respective surfaces of such elements. Furthermore, the articulated tip 44 includes a head 102 which is movably positioned within retainer 98. Retainer 98 further includes a radially inwardly extending ledge 104 which prevents removal of the head 102 of the articulated tip 44.

Figure 2B:
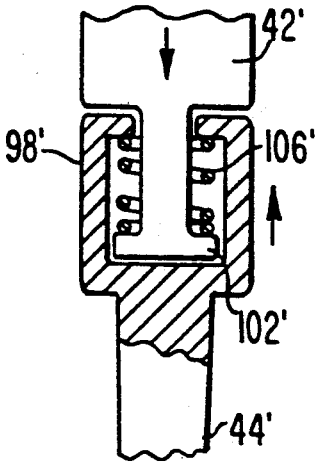
FIG. 2*b* is an alternate embodiment of the articlulated tip connection means.

Moreover, the radially inwardly extending ledge 104 further preferably supports a spring 106 thereabove which is a typical expansion spring that biases the head 102 and thus the articulated tip 44 against a lower surface of the boss 100. It is understandable that it is not necessary for such a spring bias to be present at all, in fact, it is also possible to bias the articulated tip 44 in the other direction. As can be best seen in FIG. 2a, the articulated tip 44 is movable with respect to the lower plunger 42 by a spaced axial distance defined by the retainer 98 and the lower surface of the boss portion 100 of the lower plunger 42. Furthermore, the articulated tip 44 includes a conical tip portion 107 that seats against a seat 108 of the one-piece cup 28 for injecting fuel and sealing the injection orifices 36. The object and specific advantages of this movable articulated tip 44 will be apparent with regard to the operation of the invention described below. An alternate embodiment of the articulated tip connection means is shown in FIG. 2b.

The lower plunger 42, the connecting means 96, and the articulated tip 44 all lie within the lower extent of the axial bore 32 extending through the unit fuel injector 10. This lower end portion of the axial bore 32, including the reduced diameter section within which the articulated tip 44 extends, is the metering chamber of the unit fuel injector 10 within which fuel to be injected is precisely metered in accordance with pressure and time principles as known in prior art open nozzle injectors. The metering chamber is shown at 112 in FIGS. 3a and 3b. The volume of fuel to be injected flows into the metering chamber 112 when the plunger assembly is fully retracted as shown in FIG. 3a and is injected as the plunger assembly advances inwardly toward an engine cylinder. A metering orifice is provided at 114 through which pressurized fuel is supplied to the metering chamber 112. It is also understood, as known in the prior art, to connect the metering orifice 114, the scavenge supply port 94 and the timing feed port 58 to a pressurized fuel supply by common rails. These common rails being supply lines that connect to all of the injectors of an internal combustion engine from a single pump source. Preferably, a timing fluid rail is provided and a separate metering fuel line is provided. The metering fuel and scavenging fuel can be taken from a common rail if desired.

In the operation of the present invention, reference is now made to FIGS. 3*a*-3*d*. As permitted by the cam profile 15 of the camshaft 14 and as influenced by the spring force generated by return spring 46, the upper plunger assembly 38 is retracted. At the same time, the lower plunger 42 and timing plunger 40 are retracted under the bias of outer spring 76 of the low speed valve mechanism 64. When the upper plunger assembly 38 is retracted sufficiently to clear the timing feed port 58, pressurized timing fluid, preferably fuel, is supplied between the upper plunger assembly 38 and the timing plunger 40 to form the timing chamber 56. During this time, the plunger valve 68 is maintained to close the orifice 54 of the timing plunger 40 under the influence of both the inner and outer springs 78 and 76, respectively. While the timing takes place, the lower plunger 42 has also moved sufficiently outwardly such that the cylindrical external surface of the retainer 98 clears the metering orifice 114 through which pressurized fuel is supplied to the metering chamber 112. Once again, the amount of fuel metered is controlled on a time and pressure basis. The injection timing is determined on the basis of the size of the timing chamber 56, whereas a larger timing chamber 56 will cause earlier closing of the metering orifice 114.

After the metering and timing, the plunger assembly is advanced by the cam profile at 15*c*. The upper plunger 38 moves inwardly to close off the timing feed port 58 which sets the axial length of the timing chamber 56 and forms a hydraulic link which acts to move the timing plunger 40 and lower plunger 42 inwardly. The size of the hydraulic link is determined on the basis of time and pressure principles. As the lower plunger 42 is moved inwardly, as seen in FIG. 3*b*, the external surface of retainer 98 shuts the metering orifice 114 and the metering quantity of fuel within the metering chamber 108 becomes pressurized by engagement of the metered fuel with the articulated tip 44 and the lower plunger 42. When the lower end of the lower plunger 42 actually contacts the metered fuel, injection of the fuel begins. During this time, the orifice 54 of the timing plunger 40 is maintained closed by the bias of the inner and outer springs 78 and 76, respectively, so as to maintain the hydraulic link within timing chamber 56. It is, of course, understood that the springs are chosen to have a spring force consistent with this need.

Moreover, and of particular importance to the present invention, during the injection, the articulated tip 44 is forced inwardly with the lower plunger 42 with the head 102 of the articulated tip 44 in abutment with the lower surface of boss portion 100 of the lower portion 42 so as to be driven thereby. The articulated tip 44 is, of course, sufficiently smaller in diameter than the inner axial bore within the injector cup 28 so that metered fuel can pass between the two in the metering stage. Thus, once the articulated tip 44 is advanced to a position wherein the tip 107 thereof engages the seat 108 at the lower end of the cup, a trapped volume of fuel is defined between the articulated tip 44 and the inner surface of the cup 28 as well as within the metering chamber 112 between the lower end of lower plunger 42 and the inner wall of the injector axial bore 32.

The unit fuel injector 10 in accordance with the present invention is capable of achieving SAC injection pressures at least as high as 30,000 psi. Thus, the trapped volume of fuel as above described can have an adverse affect on the plunger assembly. In the prior art injectors of the high pressure injector type without an articulated tip as in the present invention, this trapped volume would have an affect to tend to lift the tip of the lower plunger from its seat in the cup and would cause what is known as secondary injection. Secondary injection being the leakage of such a trapped volume of fuel into the cylinder of the internal combustion engine after burning has ceased. The result is an increase in unburned hydrocarbons in the exhaust.

With the articulated tip 44, in accordance with the present invention, the trapped volume of fuel under high pressure instead tends to push the articulated tip 44 inwardly toward its seat 108 of the cup 28 as opposed to away from the seat as in the prior art. The trapped volume of fuel advantageously acts against the upper end of the articulated tip 44 at the head 102 to thus firmly hold the tip 107 against the cup seat 108 to seal the injection orifices 36 effectively and to prevent the occurrence of secondary injection. Moreover, this happens even though no over-travel of the lower plunger 42 or the articulated tip 44 is experienced.

Over-travel is, however, experienced by the upper plunger assembly 38 and takes place after injection has occurred and as illustrated in FIG. 3*c*. The overtravel imparted to the upper plunger assembly 38 by the radially outwardmost portion of cam profile portion 15*c* is absorbed at a predetermined rate of collapse of the timing chamber 56. The predetermined rate is determined on the basis of the size of the restricted spill passage 62, the orifice 54, and the spring rates associated with outer and inner springs 76 and 78, respectively. The timing fuel that passes through the orifice 54 is spilled by way of spill ports 74 in the barrel 26 after the timing fluid pressure is great enough to move the plunger valve 68 and transverse pin 70 by an axial distance determined by slots 72 for opening metering orifice 54. This movement is, of course, influenced by both springs 76 and 78. As also seen into FIG. 3*c*, when the lower plunger 42 assumes its advanced position, the scavenge supply port 94 is put in fluidic connection with radial passage 92 through which scavenge fuel passes into the axial passage 88. The fuel is permitted to flow through the check valve ball element 86 in a conventional manner, through the radial passages 90, around the sides of the lower plunger 42 and out the spill ports 72. This scavenging not only removes any gases or pollutants that may migrate into this area of the fuel injector but also assists in cooling the plunger assembly. The scavenge operation takes place as shown in FIG. 3*d*, while the upper plunger 38 is driven inwardly to fully collapse the timing chamber 56 as the upper plunger experiences the end of injection and overtravel. After the plunger assembly is fully advanced and the timing chamber 56 is fully collapsed, the unit fuel injector 10 is ready to begin another cyclic injector operation and is riding on the cam profile portion 15*b* of camshaft 14.

The articulated tip 44 associated with the above described unit fuel injector 10 advantageously prevents secondary injection of fuel in conjunction with a unit injector that is capable of injecting very high pressure fuel into a cylinder of an internal combustion engine. Moreover, the use of the articulated tip 44 utilizes the trapped volume to hold the articulated tip 44 firmly in place against the cup seat without over-travel applied to hold the articulated tip 44 against the seat. Furthermore, the inner spring 78 of the low speed valve mechanism 64 advantageously urges the lower plunger assembly and the articulated tip 44 inwardly toward seat 108 with a small degree of force after the timing chamber 56 is fully collapsed. This relatively small force is, however, sufficient for holding the plunger assembly down without the need for over-travel, and the spring force is substantially evenly applied since spring 78 travels with the lower plunger 42 throughout its range of motion. In comparison to an over-travel situation imparted to the lower plunger wherein relatively high stresses result in the injector train as well as the injector body, the situation of the present invention results in much lower stress. Moreover, by relying on the small spring within the injector, the system becomes inherently less sensitive to train wear or injector missetting since the spring urges proper positioning of the articulated tip 44 and the lower plunger 42. As the injector train loads are reduced by the significantly lower plunger hold-down force after injection, the injector life is prolonged while friction and parasitic losses of the injector system are reduced.

While shown and described is a preferred embodiment in accordance with the present invention, it is understood that the same is not limited thereto, but is susceptible to numerous changes and modifications as obvious to those skilled in the art. Therefore, the present invention should not be limited to the details shown and described herein but is intended to cover all of the changes and modifications as are encompassed by the scope of the appended claims.

INDUSTRIAL APPLICABILITY

A fuel injector design in accordance with this invention would find application in a large variety of internal combustions engines. One particularly important application would be for small compression ignition (diesel) engines adapted for powering automobiles. Lighter truck engines and medium range horsepower engines could also benefit from the use of injectors designed in accordance with the subject invention. Furthermore, it is understood that the present invention has applicability to other open nozzle unit fuel injectors of the type which can be operated on a cyclic basis without having over-travel imparted to the injector tip. In any such injector situation not having over-travel, the present invention assures the maintenance of a sufficient hold-down pressure to prevent secondary injection caused by trapped fuel volume within the metering chamber subsequent to injection.

I claim:

1. An open nozzle unit fuel injector for use in an internal combustion engine of the type having a drive train associated with each unit injector to synchronously control each unit injector, said unit injector comprising:

an injector body having an axial bore open from one end of the injector body that terminates within a cup at another end of the injector body and at least one injection orifice passing through a tip of the cup from said axial bore, a plunger assembly reciprocably movably disposed within said axial bore for movement between a retracted position and an advanced position under the influence of a drive train to be associated with said unit fuel injector, said plunger assembly including a plunger, an articulated tip, a connection means for connecting said artriculated tip to said plunger while permitting axial movement therebetween and for allowing pressure of a trapped volume of fuel between said plunger and said articulated tip to hold the articulated tip in a closed position following termination of an injection event so as to avoid secondary injection, and a means for absorbing an over-travel imparted to said plunger by the associated drive train such that the pressure of said trapped volume of fuel is regulated without the provision of means for spilling the trapped volume, whereby said articulated tip does not experience said over-travel.

2. The unit injector of claim 1, wherein said cup of said injector body includes a seat at the termination of said axial bore that surrounds said at least one injection orifice, and said articulated tip includes a conical tip that engages said seat when said plunger assembly is fully advanced, said over-travel occurring by said plunger after said conical tip is engaged with said seat.

3. The unit injector of claim 2, wherein said means to absorb said over-travel is a variable timing means for controlling the timing of injection.

4. The unit injector of claim 3, wherein said plunger comprises an upper plunger and a lower plunger which are axially movable with respect to one another, and are separated from one another by said variable timing means.

5. The unit injector of claim 4, wherein said variable timing means comprises an expansible and collapsible chamber, means for variably expanding and collapsing said chamber and a timing plunger positioned between said upper and lower plungers.

6. The unit injector of claim 5, wherein said means for expanding and collapsing said chamber comprises a passage through said timing plunger and a low speed valve means located at an upper end of said lower plunger for controlling the opening and closing of said passage through said timing plunger.

7. The unit injector of claim 6, wherein said low speed valve means comprises a valve element connected to the upper end of said lower plunger by a means permitting a limited axial movement of said valve element relative to said lower plunger, and a first biasing means at the upper end of said lower plunger which is movable with said lower plunger for urging said valve element against said timing plunger to close said passage and to urge said lower plunger and said articulated tip toward said at least one injection orifice thereby providing a sufficient hold down force effective to prevent secondary injection.

8. The unit injector of claim 7, wherein said first biasing means comprises a first spring located within a bore that opens to the upper end of said lower plunger, said first spring abutting a bottom of said bore and said valve element.

9. The unit injector of claim 7, wherein said low speed valve means further comprises a second biasing means for urging said valve element to close said passage of said timing plunger, said second biasing means comprising a second spring positioned between said valve element and a shoulder of said injector body adjacent said axial bore thereof.

10. The unit injector of claim 8, wherein said low speed valve means further comprises a second biasing means for urging said valve element to close said passage of said timing plunger, said second biasing means comprising a second spring positioned between said valve element and a shoulder of said injector body adjacent said axial bore thereof.

11. A high pressure open nozzle unit fuel injector for use in an internal combustion engine of the type having a drive train associated with each unit injector to synchronously control each unit injector, said unit injector comprising:

an injector body having an axial bore open from one end of the injector body that terminates within a cup at another end of the injector body, at least one injection orifice passing through a tip of the cup from said axial bore and a sea at the termination of said axial bore surrounding said at least one injection orifice, a plunger assembly reciprocably movably disposed within said axial bore for movement between a retracted position and an advanced position under the influence of a drive train to be associated with said unit fuel injector, said plunger assembly including a plunger, an articulated tip, a connection means for connecting said articulated tip to said plunger while permitting axial movement therebetween and for allowing pressure of a trapped volume of fuel between said plunger and said articulated tip to hold the articulated tip in a closed position following termination of an injection event so as to avoid secondary injection, and a means for absorbing an over-travel imparted to said plunger by the associated drive train such that the pressure of said trapped volume of fuel is regulated without the provision of means for spilling the trapped volume, and without said articulated tip experiencing said over-travel, said over-travel constituting a distance of travel by said plunger which occurs after a tip portion of said articulated tip engages said seat.

12. The high pressure unit injector of claim 11, wherein said means to absorb said over-travel is a variable timing means for controlling the timing of injection.

13. The high pressure unit injector of claim 12, wherein said plunger comprises an upper plunger and a lower plunger which are axially movable with respect to one another, and are separated from one another by said variable timing means.

14. The high pressure unit injector of claim 13, wherein said variable timing means comprises an expansible and collapsible chamber, means for variably expanding and collapsing said chamber and a timing plunger positioned between said upper and lower plungers.

15. The high pressure unit injector of claim 14, wherein said means for expanding and collapsing said chamber comprises a passage through said timing plunger and a low speed valve means located at an upper end of said lower plunger for controlling the opening and closing of said passage through said timing plunger.

16. The high pressure unit injector of claim 15, wherein said low speed valve means comprises a valve element connected to the upper end of said lower plunger by means permitting a limited axial movement of said valve element relative to said lower plunger, and a first biasing means at the upper end of said lower plunger which is movable with said lower plunger for urging said valve element against said timing plunger to close said passage and to urge said lower plunger and said articulated tip toward said at least one injection orifice thereby providing a sufficient hold down force effective to prevent secondary injection.

17. The high pressure unit injector of claim 16, wherein said first biasing means comprises a first spring located within a bore that opens to the upper end of said lower plunger, said first spring abutting a bottom of said bore and said valve element.

18. The high pressure unit injector of claim 16, wherein said low speed valve means further comprises a second biasing means for urging said valve element to close said passage of said timing plunger, said second biasing means comprising a second spring positioned between said valve element and a shoulder of said injector body adjacent said axial bore thereof.

19. The high pressure unit injector of claim 17, wherein said low speed valve means further comprises a second biasing means for urging said valve element to close said passage of said timing plunger., said second biasing means comprising a second spring positioned between said valve element and a shoulder of said injector body adjacent said axial bore thereof.

20. The high pressure unit injector of claim 11, wherein said connection means comprises a retainer attached to one of said plunger and said articulated tip, an element fixed with the other of said plunger and said articulated tip, said element disposed within said retainer while permitting a limited relative axial movement therebetween, and a tip biasing means for urging said articulated tip into axial engagement with said plunger.

21. An open nozzle fuel injector for use in an internal combustion engine of the type having a drive train associated with each unit injector to synchronously control each unit injector, said unit injector comprising:

an injector body having an axial bore open from one end of the injector body that terminates within a cup at another end of the injector body and at least one injection orifice passing through a tip of the cup from said axial bore, a plunger assembly reciprocably movable disposed within said axial bore for movement between a retracted position and an advanced position under the influence of a drive train to be associated with said unit fuel injector, said plunger assembly including a plunger, an articulated tip, a connection means for connecting said articulated tip to the said plunger while permitting axial movement therebetween, and means for absorbing an over-travel imparted to said plunger by the associated drive train such that said articulated tip does not experience said over-travel;

wherein:

said cup of said injector body includes a seat at the termination of said axial bore that surrounds said at least one injection orifice, and said articulated tip includes a conical tip that engages said seat when said plunger assembly is fully advanced, said over-travel occurring by said plunger after said conical tip is engaged with said seat;

said means to absorb said over-travel is a variable timing means for controlling the timing of injection;

said plunger comprises an upper plunger and a lower plunger which are axially movable with respect to one another, and are separated from one another by said variable timing means;

said variable timing means comprises an expansible and collapsible chamber, means for variably expanding and collapsing said chamber and a timing plunger positioned between said upper and lower plungers;

said means for expanding and collapsing said chamber comprises a passage through said timing plunger and a low speed valve means located at an upper end of said lower plunger for controlling the opening and closing of said passage through said timing plunger; and said low speed valve means comprises a valve element connected to the upper end of said lower plunger by a means permitting a limited axial movement of said valve element relative to said lower plunger, and a first biasing means at the upper end of said lower plunger which is movable with said lower plunger for urging said valve element against said timing plunger to close said passage and to urge said lower plunger and said articulated tip toward said at least one injection orifice thereby providing a sufficient hold down force effective to prevent secondary injection

22. The unit injector of claim 21, wherein said first biasing means comprises a first spring located within a bore that opens to the upper end of said lower plunger, said first spring abutting a bottom of said bore and said valve element.

23. The unit injector of claim 21, wherein said low speed valve means further comprises a second biasing means for urging said valve element to close said passage of said timing plunger, said second biasing means comprising a second spring positioned between said valve element and a shoulder of said injector body adjacent said axial bore thereof.

24. The unit injector of claim 22, wherein said low speed valve means further comprises a second biasing means for urging said valve element to close said passage of said timing plunger, said second biasing means comprising a second spring positioned between said valve element and a shoulder of said injector body adjacent said axial bore thereof.

25. A high pressure open nozzle unit fuel injector for use in an internal combustion engine of the type having a drive train associated with each unit injector to synchronously control each unit injector, said unit injector comprising:

an injector body having an axial bore open from one end of the injector body that terminates within a cup at another end of the injector body, at least one injection orifice passing through a tip of the cup from said axial bore and a seat at the termination of said axial bore surrounding said at least one injection orifice, a plunger assembly reciprocably movably disposed within said axial bore for movement between a retracted position and an advanced position under the influence of a drive train to be associated with said unit fuel injector, said plunger assembly including a plunger, an articulated tip, a connection means for connecting said articulated tip to the said plunger while permitting axial movement therebetween, and a means for absorbing an over-travel imparted to said plunger by the associated drive train without said articulated tip experiencing said over-travel, said over-travel constituting a distance of travel by said plunger which occurs after a tip portion of said articulated tip engages said seat;

wherein:

said means to absorb said over-travel is a variable timing means for controlling the timing of injection;

said plunger comprises an upper plunger and a lower plunger which are axially movable with respect to one another, and are separated from one another by said variable timing means;

said variable timing means comprises an expansible and collapsible chamber, means for variably expanding and collapsing said chamber and a timing plunger positioned between said upper and lower plungers;

said means for expanding and collapsing said chamber comprises a passage through said timing plunger and a low speed valve means located at an upper end of said lower plunger for controlling the opening and closing of said passage through said timing plunger; and said low speed valve means comprises a valve element connected to the upper end of said lower plunger by means permitting a limited axial movement of said valve element relative to said lower plunger, and a first biasing means at the upper end of said lower plunger which is movable with said lower plunger for urging said valve element against said timing plunger to close said passage and to urge said lower plunger and said articulated tip toward said at least one injection orifice thereby providing a sufficient hold down force effective to prevent secondary injection.

26. The high pressure unit injector of claim 25, wherein said first biasing means comprises a first spring located within a bore that opens to the upper end of said lower plunger, said first spring abutting a bottom of said bore and said valve element.

27. The high pressure unit injector of claim 25, wherein said low speed valve means further comprises a second biasing means for urging said valve element to close said passage of said timing plunger, said second biasing means comprising a second spring positioned between said valve element and a shoulder of said injector body adjacent said axial bore thereof.

* * * * *